US012025005B2

(12) United States Patent
Xu et al.

(10) Patent No.: US 12,025,005 B2
(45) Date of Patent: Jul. 2, 2024

(54) EASY BUILDING-UP HYBRID ROTARY STEERABLE DRILLING SYSTEM

(71) Applicant: Xiaoyue Wan, Beijing (CN)

(72) Inventors: Zichen Xu, Beijing (CN); Xiaoyue Wan, Beijing (CN)

(73) Assignee: Xiaoyue WAN, Beijing (CN)

( * ) Notice: Subject to any disclaimer, the term of this patent is extended or adjusted under 35 U.S.C. 154(b) by 258 days.

(21) Appl. No.: 17/596,203

(22) PCT Filed: Jun. 8, 2020

(86) PCT No.: PCT/CN2020/094998

§ 371 (c)(1),
(2) Date: Dec. 6, 2021

(87) PCT Pub. No.: WO2020/244671

PCT Pub. Date: Dec. 10, 2020

(65) Prior Publication Data

US 2022/0316279 A1 Oct. 6, 2022

(30) Foreign Application Priority Data

Jun. 6, 2019 (CN) ..... 201910490984.9
Jun. 6, 2019 (CN) ..... 201910491504.0
(Continued)

(51) Int. Cl.
*E21B 7/06* (2006.01)
*E21B 47/022* (2012.01)

(52) U.S. Cl.
CPC ..... *E21B 7/061* (2013.01); *E21B 7/064* (2013.01); *E21B 47/022* (2013.01)

(58) Field of Classification Search
CPC ..... E21B 7/061; E21B 7/062; E21B 47/022
See application file for complete search history.

(56) References Cited

U.S. PATENT DOCUMENTS 5,553,679 A 9/1996 Thorp
10,221,627 B2 3/2019 Bayliss
(Continued)

FOREIGN PATENT DOCUMENTS

CN 102913131 A 2/2013
CN 102947533 A 2/2013
(Continued)

OTHER PUBLICATIONS

Zheng Deshuai, et al., Study on deflection performance of backup and directional types of rotary steering tools, Oil Drilling & Production Technology, 2011, pp. 10-13. vol. 33. No.6.

*Primary Examiner* — Tara Schimpf
*Assistant Examiner* — Lamia Quaim
(74) *Attorney, Agent, or Firm* — Bayramoglu Law Offices LLC

(57) ABSTRACT

An easy building-up hybrid rotary steerable drilling system includes a front supporting body, a weight-on-bit (WOB)-torque-on-bit (TOB) deflectable transmission joint and a deflection control system. The WOB-TOB deflectable transmission joint includes a universal joint. A front end of the front supporting body is fixedly connected to a drill bit, and a rear end of the front supporting body is fixedly connected to an outlet end of the universal joint. A front push-the-bit assembly is provided on a circumferential surface of the front supporting body. The deflection control system controls radial push-the-bit parts of the front push-the-bit assembly to push a borehole wall along a radial direction of the front supporting body, such that the front supporting body generates a deviation angle relative to an input shaft of the universal joint by taking a center point of the universal joint as a center, thereby controlling a drilling direction.

21 Claims, 7 Drawing Sheets

(30) Foreign Application Priority Data

Nov. 6, 2019 (CN) ..... 201911074897.1
Jun. 5, 2020 (CN) ..... 202010507545.7

(56) References Cited

U.S. PATENT DOCUMENTS

| | | | | |
|---|---|---|---|---|
| 2012/0160565 | A1 | 6/2012 | Downton et al. | |
| 2016/0108679 | A1* | 4/2016 | Bayliss | E21B 7/068 175/45 |
| 2016/0326804 | A1* | 11/2016 | Gao | E21B 7/067 |
| 2020/0300061 | A1* | 9/2020 | Iguaz | E21B 23/12 |
| 2021/0062585 | A1* | 3/2021 | Nanayakkara | E21B 7/065 |

FOREIGN PATENT DOCUMENTS

| | | | |
|---|---|---|---|
| CN | 203201467 | U | 9/2013 |
| CN | 107676040 | A | 2/2018 |
| CN | 107939291 | A | 4/2018 |
| CN | 108035677 | A | 5/2018 |
| CN | 109458134 | A | 3/2019 |
| CN | 109690014 | A | 4/2019 |
| CN | 110617011 | A | 12/2019 |

* cited by examiner

EASY BUILDING-UP HYBRID ROTARY STEERABLE DRILLING SYSTEM

TECHNICAL FIELD

The present invention relates to the technical field of oil exploitation and drilling, and more particularly, to an easy building-up hybrid rotary steerable drilling system.

BACKGROUND

Rotary steerable drilling has been the state-of-the-art drilling technology in the world. On the basis of working modes of the bottom hole assembly (BHA), rotary steerable systems (RSSs) can be divided into four categories: static bias push-the-bit, dynamic bias push-the-bit, static bias point-the-bit and dynamic bias point-the-bit. The push-the-bit and the point-the-bit are distinguished according to different steering principles of the drill bit. Specifically, the push-the-bit biases the drill bit at a near-bit position through the bias mechanism (the piston pushes the borehole wall) and directly provides the lateral force for the drill bit, while the point-the-bit makes the drill bit deviate from a wellbore axis directly or indirectly through the bias mechanism (the eccentric ring or the eccentric disc) to point the steering direction. Meanwhile, the bias mechanism has two working modes, namely the static bias and the dynamic bias. Specifically, the static bias refers to that the bias mechanism during drilling does not rotate with the drill string and can provide the lateral force at a certain constant direction, while the dynamic bias refers to that the bias mechanism during drilling rotates with the drill string and can provide the periodic lateral force at a certain position through the control system.

In the technical paper, "*Studies on Building-up Performance of Push-the-Bit and Point-the-Bit Rotary Steerable Tools*" presented by Deshuai ZHENG, Deli GAO, Jiangpeng FENG and Hongbai ZHANG, Oil Drilling & Production Technology, 2011, 33(6): 10-13, evaluations are made to advantages and disadvantages of the building-up performance of various rotary steerable tools. Specifically, under the very large lateral force from the driving piston of the bias mechanism, the push-the-bit RSSs can push the drill bit to deviate from the original wellbore for slow steering, namely it can only achieve the small rotation angle (inclination angle) of the drill bit, which cannot implement the highly efficient building-up function and has the low building-up rate; and due to the very large lateral force applied to the drill bit during the steering, it is hard to control the wellbore orientation and form the desirable wellbore trajectory, that is, the building-up stability is poor. Specifically, in addition to the above drawbacks, the static bias push-the-bit RSSs also have the low building-up rate and cannot drill the wellbore with the high building-up rate.

In addition, through long-term practices, the push-the-bit part in the dynamic bias push-the-bit RSSs faces the serious wear and the low service life because it rotates with the drill bit and greatly collides with the rocks under hundreds of kilograms to tons of pushing pressures, and the drilling operation often does not proceed due to the failure of the push-the-bit part. Hence, it is highly desirable to develop an easy building-up steering structure, to cope with problems at the site.

The static bias point-the-bit RSSs control a combination of eccentric rings above the drill bit, such that the drill bit is biased in a constant direction to achieve the stable building-up rate. However, due to the lack of the diameter-variable and reliable support at the lower side of the drill bit for the shape of the wellbore, mechanisms and components such as the eccentric ring and the central driving shaft are under a high-strength alternating stress during steering and are prone to fatigue failure; and furthermore, the control unit must be provided on a stable platform. The dynamic bias point-the-bit RRSs maintains the deflection under the help of an independent reverse motor, which impose high requirements on the motor power. In addition, the dynamic bias RSSs in other forms also present the problems of the difficult control of the wellbore trajectory, etc.

SUMMARY

An objective of the present invention is to provide an easy building-up hybrid rotary steerable drilling system. The present invention controls the radial push-the-bit parts of the front push-the-bit assembly to push the borehole wall toward the radial direction of the front supporting body, such that the front supporting body generates the deviation angle relative to the input shaft of the universal joint by taking the center point of the universal joint in the weight-on-bit (WOB)-torque-on-bit (TOB) deflectable transmission joint as the center and the contact point between the centralizer and the borehole wall as the fulcrum, thereby implementing the hybrid rotary steerable function. The system only needs to generate a very small pushing deflection force through the front push-the-bit assembly, such that the universal joint rotates to implement the rotary steerable function on the drill bit; and with the contact point between the centralizer and the borehole wall as the fulcrum, the system is more reliable and more stable in building up.

The present invention adopts the following technical solutions.

An easy building-up hybrid rotary steerable drilling system includes a front supporting body, a WOB-TOB deflectable transmission joint and a deflection control system, where the WOB-TOB deflectable transmission joint includes a universal joint; a front end of the front supporting body is fixedly connected to a drill bit, and a rear end of the front supporting body is fixedly connected to an outlet end of the universal joint; a front push-the-bit assembly is provided on a circumferential surface of the front supporting body; and the deflection control system controls radial push-the-bit parts of the front push-the-bit assembly to push a borehole wall along a radial direction of the front supporting body, such that the front supporting body generates a deviation angle relative to an input end of the universal joint by taking a center point of the universal joint as a center.

It is to be noted that the deflection control system is partially or completely provided on the front supporting body.

Preferably, the easy building-up hybrid rotary steerable drilling system may further include a centralizer behind the front push-the-bit assembly; if a center point of the centralizer is located behind the center point of the universal joint, a distance between the center point of the centralizer and the center point of the universal joint may not be greater than 3 times a diameter of the drill bit; and the deflection control system may control the radial push-the-bit parts of the front push-the-bit assembly to push the borehole wall along the radial direction of the front supporting body, such that the front supporting body generates a deviation angle relative to an axis of the input end of the universal joint by taking the center point of the universal joint as a center and a contact point between the centralizer and the borehole wall as a fulcrum.

Preferably, each of the front supporting body and the WOB-TOB deflectable transmission joint may have a circulation structure, and the circulation structure may form a main flow channel for allowing a circulating drilling medium to flow through.

Preferably, the easy building-up hybrid rotary steerable drilling system may further include an elastic flow pipe penetrating a hollow structure of the universal joint and connected to the input end and the outlet end of the universal joint.

Preferably, an elastic stabilizing device for obstructing the front push-the-bit assembly from driving the front supporting body to rotate around the universal joint may be provided in the WOB-TOB deflectable transmission joint, and the elastic stabilizing device may keep an input shaft and an output shaft of the universal joint in a coaxial state. The input shaft may be a supporting drill collar connected to the input end of the universal joint, and the output shaft may be a supporting drill collar connected to the outlet end of the universal joint.

Preferably, the elastic stabilizing device may include an elastic pipe penetrating a hollow structure of the universal joint and connected to the input end and the outlet end of the universal joint. With the full use of the space near the universal joint, the circulation structure can provide a larger deformation space for the elastic pipe, such that the elastic pipe can withstand greater deformation. The elastic pipe provides a damping force for making the input shaft and the output shaft of the universal joint colinear. The damping force is far less than a force to be overcome by the conventional flexible joint for deflection, and the bending deflection point is lower, which achieves better steering performance of the tool.

Preferably, a limit mechanism may include a lever structure and a supporting drill collar housing, a deflection space may be formed between the lever structure and an inner wall of the supporting drill collar housing, and the lever structure may be in contact with the inner wall of the supporting drill collar housing and may be configured to withstand a pushing force of a rotary steerable hydraulic piston and/or a bending moment caused by downhole vibration and/or a lateral component force caused by a WOB.

Preferably, the elastic stabilizing device may include a plurality of elastic shafts annularly arranged in central symmetry in the supporting drill collar housing of the universal joint, and the elastic shafts provide a damping force for making the input shaft and the output shaft of the universal joint colinear; and/or the elastic stabilizing device may include a plurality of leaf springs arranged in the deflection space between the lever structure and the supporting drill collar housing.

The elastic stabilizing device may include an elastic pipe respectively coaxially connected to the input end and the outlet end of the universal joint, or, the elastic stabilizing device may include an elastic pipe coaxially connected to either the input end or the outlet end of the universal joint, and radially and limitedly connected to the other end; a variable clearance may be formed between the elastic pipe and the universal joint; and a wall thickness of the elastic pipe may be 2-15% of a maximum diameter of the drill bit, so as to provide an enough bending moment.

Preferably, the WOB-TOB deflectable transmission joint may further include a limit mechanism for limiting the deviation angle within a range of 0-5°; and when the WOB-TOB deflectable transmission joint rotates by any deviation angle within the range of 0-5°, a restoring force provided by the elastic stabilizing device for driving the input end and the outlet end of the universal joint to restore the coaxial state may overcome a radial component force from a maximum rated WOB at the angle. The radial component force may be approximately obtained by multiplying the WOB with sin $\alpha$, and may keep the input end and the outlet end of the universal joint in a tendency of restoring the coaxial state.

Preferably, the deflection control system may include an electrical actuating device configured to control the radial push-the-bit parts to push the borehole wall toward the radial direction of the front supporting body to generate a deflection force, an attitude measuring device configured to measure the deviation angle of the front supporting body, and a downhole computing device; and the downhole computing device may include a computing chip electrically connected to the attitude measuring device, the electrical actuating device and a power supply device.

Preferably, the computing chip may receive deviation angle information acquired by the attitude measuring device, compare the deviation angle information with target deviation angle information to compute a steering direction and a steering force, and further control the electrical actuating device to drive the front push-the-bit assembly to generate a combined pushing force reverse to the steering direction to act on the borehole wall; and a closed-loop control may be performed to maintain a rotation angle and a rotation amplitude of the WOB-TOB deflectable transmission joint to be consistent with preset values.

Preferably, the attitude measuring device may include a deflection sensor configured to measure a rotation angle and a rotation direction of the universal joint in the WOB-TOB deflectable transmission joint; the corresponding deviation angle information may include rotation direction information and rotation angle information, measured by the deflection sensor, of the front supporting body relative to the input shaft of the universal joint; and the target deviation angle information may include rotation direction information and rotation angle information, prestored in the downhole computing device or downlinked to the downhole computing device through a communication device, of the front supporting body relative to the input end of the universal joint.

Preferably, the attitude measuring device may include a first accelerometer and/or a first magnetometer on the front supporting body; the corresponding deviation angle information may include inclination angle information and azimuth angle information measured by the accelerometer and the magnetometer; and the target deviation angle information may include target inclination angle information and target azimuth angle information, prestored in the downhole computing device or downlinked to the downhole computing device through a communication device, of the front supporting body relative to the input shaft of the universal joint.

Preferably, the attitude measuring device may include an accelerometer and/or a magnetometer on the front supporting body, and may further include a rear attitude measuring device behind the WOB-TOB deflectable transmission joint; the rear attitude measuring device may at least include a group of rear acceleration sensors and a group of rear magnetometers, and may be configured to measure an attitude in an environment with relatively small vibration and magnetic disturbance; the deviation angle information may include inclination angle information and azimuth angle information measured by a first accelerometer and the second magnetometers; and the target deviation angle information may include target inclination angle information and target azimuth angle information, prestored in the downhole computing device or downlinked to the downhole computing device through a communication device, of the front supporting body relative to the input shaft of the universal joint.

Preferably, an axial distance between the centralizer and the center point of the universal joint may be less than or equal to 8 times a maximum diameter of the drill bit; and at least one WOB-TOB deflectable transmission mechanism may be provided within a distance being 20 times the maximum diameter of the drill bit toward the drill bit; and/or an average outer diameter of the front supporting body may be 50-100% of an outer diameter of the drill bit.

Preferably, 2-6 groups of front push-the-bit assemblies may be arranged in central symmetry on the circumferential surface of the front supporting body, the front push-the-bit assembly may include a hydraulic piston and radial push-the-bit parts, the front supporting body and the push-the-bit parts rotate synchronously with the drill bit, and a plurality of groups of push-the-bit parts periodically push the borehole wall to generate a combined force for steering an orientation of the front supporting body; and the radial push-the-bit parts may include a wing rib or a hydraulic piston-driven bushing; the hydraulic piston may be powered by a circulating drilling medium in a main flow channel; and the electrical actuating device may alternately provide a high-pressure drilling fluid in the main flow channel for the hydraulic piston by controlling a flow diverting device.

Preferably, the electrical actuating device may include a motor, an rotary valve driven by the motor and a motor driver; the rotary valve driven by the motor may include a rotary valve motor end and a rotary valve follow-up end; and the motor driver may be provided on the downhole computing device, and may rotate the rotary valve motor end relative to the rotary valve follow-up end according to a control instruction of the downhole computing device, thereby diverting mud through the flow diverting device to control a front wing rib assembly.

Preferably, the rigid universal joint may be a cross-axle universal joint, a ball cage universal joint, a Bendix-Weiss universal joint or a ball-and-socket hinge universal joint.

Preferably, the power supply device may include a downhole turbine generator, where the downhole turbine generator is provided behind the WOB-TOB deflectable transmission joint.

Preferably, a communication device may further be provided behind the WOB-TOB deflectable transmission joint to implement communication between the downhole computing device and a wellhead device.

Preferably, a first WOB-TOB deflectable transmission joint and a second WOB-TOB deflectable transmission joint may be sequentially arranged behind the front supporting body; a distance between a center point of a universal joint of the first WOB-TOB deflectable transmission joint and a center point of a universal joint of the second WOB-TOB deflectable transmission joint may be less than 3 times a maximum diameter of the drill bit; the centralizer may be provided between the first WOB-TOB deflectable transmission joint and the second WOB-TOB deflectable transmission joint, or the centralizer may be provided in front of the first WOB-TOB deflectable transmission joint; a distance from a centroid of the universal joint of the first WOB-TOB deflectable transmission joint to a centroid of the drill bit may be less than 20 times the maximum diameter of the drill bit; an input shaft of the universal joint of the first WOB-TOB deflectable transmission joint may be fixedly connected to an output shaft of the universal joint of the second WOB-TOB deflectable transmission joint; the first WOB-TOB deflectable transmission joint may include a first elastic stabilizing device; and the second WOB-TOB deflectable transmission joint may include a second elastic stabilizing device.

Preferably, the front supporting body may include a steering sleeve and a central shaft freely rotating in the steering sleeve through a radial anti-thrust bearing and an axial anti-thrust bearing; the front push-the-bit assembly may be provided on a circumferential surface of the steering sleeve; a front end of the central shaft may be fixedly connected to the drill bit, and a rear end of the central shaft may be fixedly connected to an supporting housing of the outlet end of the universal joint; the WOB-TOB deflectable transmission joint may further include the supporting housing, sleeved outside the universal joint, at the outlet end of the universal joint; a clearance may be formed between the supporting housing of the outlet end of the universal joint and the universal joint to form a deflection space; the universal joint can rotate by 0-5° in the deflection space relative to an axis of a fixed sleeve; the centralizer may be provided outside the supporting housing for the output shaft of the universal joint; and a distance between a center point of the centralizer and a universal joint of a first WOB-TOB deflectable transmission joint may be less than or equal to 2 m. The supporting housing in the present invention is the drill collar housing capable of withstanding and transmitting a WOB and a TOB.

Preferably, the easy building-up hybrid rotary steerable drilling system may further include one or more series-connected universal WOB-TOB transmission joints behind the WOB-TOB deflectable transmission joint; each of the universal WOB-TOB transmission joints may include the universal joint and the limit mechanism; each of the WOB-TOB deflectable transmission joint and the universal WOB-TOB transmission joints has a circulation structure; and a distance between center points of universal joints of the universal WOB-TOB transmission joints may be less than 10 times a maximum diameter of the drill bit; and a distance from a centroid of a universal joint in a WOB-TOB deflectable transmission joint nearest to the drill bit to the drill bit may be less than 15 times the maximum diameter of the drill bit. Therefore, the front supporting body is prevented from scratching the high-curvature borehole wall, to implement controllable wellbore trajectory exploration at a high building-up rate in case of a short length of the front supporting body.

Preferably, the elastic stabilizing device may penetrate the WOB-TOB deflectable transmission joint and the universal WOB-TOB transmission joints.

Preferably, each of the WOB-TOB deflectable transmission joint and the universal WOB-TOB transmission joints may have a circulation structure; and the elastic stabilizing device may penetrate the WOB-TOB deflectable transmission joint and the plurality of universal WOB-TOB transmission joints; and/or, the easy building-up hybrid rotary steerable drilling system may further include the elastic flow pipe penetrating the hollow structure of the universal joint and connected to the input end and the outlet end of the universal joint.

Preferably, a sum for a length of a universal WOB-TOB transmission joint array formed by the plurality of series-connected universal WOB-TOB transmission joints, a length of the front supporting body and a length of the drill bit may be greater than a length of a multilateral well section, so as to implement controllable trajectory exploration of a multilateral straight wellbore having a hole curvature of greater than 1°/m; and a distance from a WOB-TOB deflectable transmission joint nearest to the drill bit to a front end surface of the drill bit may not be greater than 8 times a maximum diameter of the drill bit.

Preferably, only one centralizer may be provided between the WOB-TOB deflectable transmission joint nearest to the drill bit and the drill bit; and a distance from a center of the centralizer to the drill bit may be greater than a distance from the centralizer to the WOB-TOB deflectable transmission joint nearest to the drill bit, and the centralizer is configured to centralize the WOB-TOB deflectable transmission joint nearest to the drill bit at a near-bit position, thereby preventing a radial force from a rear universal WOB-TOB transmission joint in a downhole vibration condition from disturbing wellbore trajectory control.

Preferably, a power transmission line may be provided in a WOB-TOB deflectable transmission joint behind the front supporting body, and the power transmission line may be provided in the plurality of series-connected universal WOB-TOB transmission joints behind the WOB-TOB deflectable transmission joint; and the power transmission line may be respectively electrically connected to a deflection control system, an attitude measuring device and a power source to supply power to the deflection control system and the attitude measuring device at a near-bit position.

Preferably, the universal WOB-TOB transmission joints provided with the power transmission line may be a part or all of the universal WOB-TOB transmission joints from front to back. Preferably, the power source may be a downhole battery or a downhole turbine generator.

The present invention has the following advantages over the prior art:

1. According to the easy building-up hybrid rotary steerable drilling system provided by the present invention, the deflection control system controls the radial push-the-bit parts of the front push-the-bit assembly to push the borehole wall along the radial direction of the front supporting body, such that the front supporting body generates the deviation angle relative to the input shaft of the universal joint by taking the center point of the universal joint as the center, thereby controlling the drilling direction and improving the building-up rate. The present invention generates the deviation angle by only overcoming a small force for deflecting the universal joint, thereby reducing the pushing force of the front push-the-bit assembly and making the system more reliable. Particularly compared with the dynamic bias in which the front supporting body and the front push-the-bit assembly rotate with the drill bit, the present invention achieves the same steering effect with a smaller force, indicating that the present invention reduces the interaction force between the push-the-bit part and the rock; and with the same revolutions per minute (RPM) and the same footage, the present invention drastically reduces the wear of the radial push-the-bit parts and greatly lowers the probability that the radial push-the-bit parts is failed. Compared with the mud-driven dynamic bias, the present invention also greatly reduces the pressure difference between the wellbore and the annulus, which is favorable to reduce the overall pressure consumption of the tool and achieves the great engineering significance and practical value.

2. According to the easy building-up hybrid rotary steerable drilling system provided by the present invention, when the centralizer is provided between the center point of the universal joint and the front push-the-bit assembly, the front supporting body under the action of the push-the-bit assembly rotates around the universal joint to change the wellbore trajectory; and in this case, the centralizer supports the system. The center point of the centralizer 5 coincides with the center point of the universal joint 21 to further reinforce the building-up stability.

3. As the elastic stabilizing device for obstructing the front push-the-bit assembly from driving the front supporting body to rotate around the center point of the universal joint is provided in the WOB-TOB deflectable transmission joint, the easy building-up hybrid rotary steerable drilling system provided by the present invention further increases the stability of the system; and the easy building-up hybrid rotary steerable drilling system can be applied to the wellbore for building up as well as the conventional straight well exploration, with the universal joint not easily failed under the action of the impact force, WOB and lateral vibration. When the WOB-TOB deflectable transmission joint rotates by any deviation angle, the restoring force provided by the elastic stabilizing device for driving the input end and the outlet end of the universal joint to restore the coaxial state should be greater than the radial component force from the maximum rated WOB at the angle.

4. As the WOB-TOB deflectable transmission joint further includes the limit mechanism 23 for limiting the deviation angle within the range of 0-5° and withstanding the pushing force of the rotary steerable hydraulic piston or the bending moment from the downhole vibration, the easy building-up hybrid rotary steerable drilling system provided by the present invention prolongs the service life of the universal joint.

5. The deflection control system includes the electrical actuating device configured to control the radial push-the-bit parts to push the borehole wall toward the radial direction of the front supporting body to generate the deflection force, the attitude measuring device configured to measure the deviation angle of the universal joint and the downhole computing device; the attitude measuring device, the electrical actuating device and the power supply device are electrically connected to the computing chip of the downhole computing device; the computing chip receives the deviation angle information acquired by the attitude measuring device, compares the deviation angle information with the target deviation angle information to compute the steering direction and the steering force, and further controls the electrical actuating device to drive the front push-the-bit assembly to generate the combined pushing force reverse to the steering direction to act on the borehole wall; and the closed-loop control is performed to maintain the rotation angle and the rotation amplitude of the WOB-TOB deflectable transmission joint to be consistent with preset values. Therefore, the easy building-up hybrid rotary steerable drilling system provided by the present invention is controlled simply and reliably, and implemented easily. Moreover, due to the small pushing force of the front push-the-bit assembly, the electrical actuating device can alternately provide the high-pressure drilling fluid in the main flow channel M for the hydraulic piston 42 by controlling the flow diverting device, thereby controlling the deflection of the front supporting body and preventing the external power source for the hydraulic piston of the front push-the-bit assembly.

6. For the wellbore having the building-up rate of less than 20°/30 m, the easy building-up hybrid rotary steerable drilling system provided by the present invention can continuously provide two WOB-TOB deflectable transmission joints behind the front supporting body, thereby greatly increasing the maximum rotation angle of the front supporting body relative to the input end of the universal joint, and reducing the wear of the universal joint.

7. For the problem that deep wellbore trajectory of the ultra-short radius (having a hole curvature of greater than 1°/m) multilateral well cannot be controlled, by providing the universal WOB-TOB transmission joint array behind the WOB-TOB deflectable transmission joint, the easy building-up hybrid rotary steerable drilling system provided by the present invention is adapted to the high curvature without affecting the WOB-TOB transmission, and ensures the stability of wellbore trajectory control during steering, thereby solving the contradictions between the WOB-TOB transmission, the adaptability for high-curvature wellbore and the stability of wellbore trajectory control. Furthermore, the front supporting body, the steering method, the WOB-TOB deflectable transmission joint and/or the universal WOB-TOB transmission joint in the present invention are all for the ease of miniaturization, and can be shortened or lengthened according to drilling requirements. Therefore, the easy building-up hybrid rotary steerable drilling system can be adapted to the hole curvature with the high building-up rate and can stably control the wellbore trajectory, providing effective means for the wellbore trajectory control in all sections of the ultra-short radius multilateral well.

Figure 1:
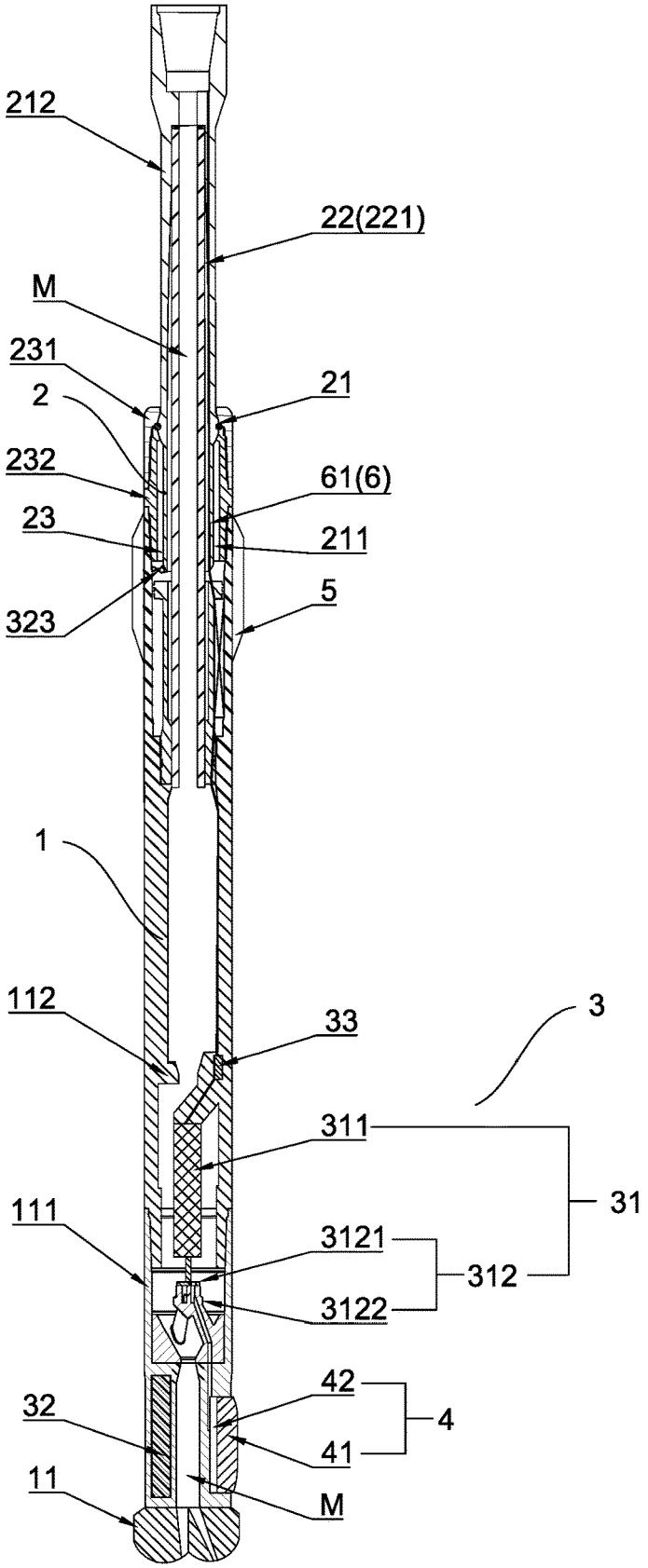
FIG. 1 is a schematic view illustrating an axial section of an easy building-up hybrid rotary steerable drilling system according to Embodiment 1 of the present invention.

Reference numerals in the drawings are as follows:

1—front supporting body, 11—drill bit, 111—drill bit connecting member, 112—universal joint connecting member, 12—steering sleeve, 121—radial anti-thrust bearing, 122—axial anti-thrust bearing, and 13—central shaft;

2—WOB-TOB deflectable transmission joint, 21—universal joint, 211—output shaft of the universal joint, 212—input shaft of the universal joint, 22—elastic stabilizing device, 221—elastic pipe, M—main flow channel, 222—leaf spring, 223—pressure seal, 23—limit mechanism, 232—supporting drill collar housing, 24—fixed sleeve, 25—deflection space, and 28—elastic flow pipe;

2A—first WOB-TOB deflectable transmission joint, 2B—second WOB-TOB deflectable transmission joint, 21A—universal joint of the first WOB-TOB deflectable transmission joint, 21B—universal joint of the second WOB-TOB deflectable transmission joint, 22A—first elastic stabilizing device, 22B—second elastic stabilizing device, 26—antifouling seal, and 27—anti-drop member;

3—deflection control system, 31—electrical actuating device, 311—motor, 312—rotary valve driven by the motor, 3121—rotary valve motor end, and 3122—rotary valve follow-up end;

32—attitude measuring device, 321—first accelerometer, 322—first magnetometer, 33—downhole computing device, 323—deflection sensor, and 323—rear attitude measuring device;

4—front push-the-bit assembly, 41—radial push-the-bit parts, 411—wing rib, and 42—hydraulic piston;

5—centralizer;

6—power supply device, and 61—cable and energy power transmission line;

7—universal WOB-TOB transmission joint; and

8—main well.

DETAILED DESCRIPTION OF THE EMBODIMENTS

For ease of understanding on the present invention, the present invention will be described below in more detail in combination with FIGS. 1-8 and specific embodiments. The easy building-up hybrid rotary steerable drilling system provided by the present invention is a combination of the push-the-bit RSS and the point-the-bit RSS, regardless of the dynamic bias or the static bias.

Embodiment 1

With the dynamic bias rotary steerable drilling system as an example, as shown in FIG. 1, an easy building-up hybrid rotary steerable drilling system includes a front supporting body 1, a WOB-TOB deflectable transmission joint 2 and a deflection control system 3, where the WOB-TOB deflectable transmission joint 2 includes a universal joint 21, and an elastic stabilizing device 22 that makes an input shaft and an output shaft of the universal joint 21 colinear, a front end of the front supporting body 1 is fixedly connected to a drill bit 11, and the drill bit 11 may be integrally formed with the front supporting body 1. A rear end of the front supporting body 1 is fixedly connected to an outlet end 211 of the universal joint 21. Certainly, the front supporting body 1 may also be integrally formed with the output shaft 211 of the universal joint 21. The input shaft 212 of the universal joint 21 may be directly and fixedly connected to a drill string. Herein, the output shaft 211 and the input shaft 212 of the universal joint 21 are the output shaft 211 and the input shaft 212 which rotate overall relative to the drill string to drive the rotation of the drill bit and transmit the WOB and the TOB to the drill bit. A front push-the-bit assembly 4 is provided on a circumferential surface of the front supporting body 1; and the deflection control system 3 generates a radial pushing force by controlling radial push-the-bit parts 41 of the front push-the-bit assembly 4 to push a borehole wall along a radial direction of the front supporting body 1, and the radial pushing force overcomes a damping force of the elastic stabilizing device 22, such that the front supporting body 1 generates a deviation angle relative to the input shaft 212 of the universal joint 21 by taking a center point of the universal joint 21 as a center. Therefore, the drill bit 11 achieves the hybrid steerable function of the push-the-bit RSS and the point-the-bit RSS, with the high building-up rate, accurate steering and convenience in wellbore trajectory control. It is to be noted that the deviation angle is a combination of the inclination angle and the azimuth angle to be deflected relative to the input shaft 212 of the universal joint 21.

With regard to generation and control of the deviation angle, the outlet end 211 of the universal joint 21 rightly serves as the input end for generating the deviation angle, namely since the radial push-the-bit parts 41 pushes the borehole wall along the radial direction of the front supporting body 1 to generate the pushing deflection force, the front supporting body 1 drives the outlet end 211 of the universal joint 21 in FIG. 1 to deflect, thereby generating the deviation angle. The present invention controls the radial push-the-bit parts 41 to push the borehole wall along different azimuths to generate the pushing deflection force through which the drill bit 11 and the front supporting body 1 rotate with the center point of the universal joint 21 as the center, thereby controlling the drilling direction and improving the building-up rate. The present invention generates the deviation angle by only overcoming a small force for deflecting the universal joint 21, which reduces the pushing force of the front push-the-bit assembly 4 and makes the system more reliable.

In order to effectively transmit the pushing effect of the front push-the-bit assembly 4 to the drill bit 11, and drive the drill bit 11 to rotate around the WOB-TOB deflectable transmission joint 2, an average outer diameter of the front supporting body 1 is 50-100% of a maximum outer diameter of the drill bit 11, and the front supporting body 1 keeps a certain rigidity necessarily. The front supporting body 1 may include a drill bit connecting member 111 and a universal joint connecting member 112, and the universal joint connecting member 112 may also be a supporting drill collar housing for the output shaft of the universal joint or the outlet end of the universal joint 21, such that a power output structure of a hydraulic piston 42 of the front push-the-bit assembly 4 is conveniently provided in the front supporting body 1.

Embodiment 2

Unlike the above embodiment, as shown in FIGS. 1-4, the easy building-up hybrid rotary steerable drilling system provided by the present invention further includes a centralizer 5 behind the front push-the-bit assembly 1, to improve the building-up stability.

The centralizer 5 is preferably provided between the front push-the-bit assembly 1 and the center point of the universal joint 21. The deflection control system 3 controls the radial push-the-bit parts 41 of the front push-the-bit assembly 4 to push the borehole wall along the radial direction of the front supporting body 1, such that the front supporting body 1 generates a deviation angle relative to the input shaft 212 of the universal joint 21 by taking the center point of the universal joint 21 as a center and a contact point between the centralizer 5 and the borehole wall as a fulcrum. In this case, the moment arm L1 is formed from the drill bit to the contact point between the centralizer 5 and the borehole wall, the moment arm L2 is formed from the center point of the universal joint 21 to the contact point between the centralizer 5 and the borehole wall, and the axial force of the rear drill string generates a component force at the universal joint 21 for reinforcing the building-up effect. Through the lever which takes the centralizer 5 as the fulcrum, the component force is transmitted to the drill bit 11 to reinforce the building-up effect.

Preferably, the center point of the centralizer 5 coincides with the center point of the universal joint 21 to further reinforce the building-up stability.

If the center point of the centralizer 5 is located behind the center point of the universal joint, an axial distance between the center point of the centralizer 5 and the center point of the universal joint is not greater than 3 times a diameter of the drill bit. In this case, the building-up stability still can be guaranteed adequately.

Preferably, as shown in FIG. 1, the front supporting body 1 and the WOB-TOB deflectable transmission joint 2 each are of a hollow structure. The elastic stabilizing device 22 includes an elastic pipe 221 penetrating a hollow structure of the universal joint 21 and connected to the input end 212 and the outlet end 211 of the universal joint 21; and a hollow structure of the front supporting body 1 and a through hole of the elastic pipe 221 are formed into a main flow channel M for allowing a circulating drilling medium to flow through.

Figure 2:
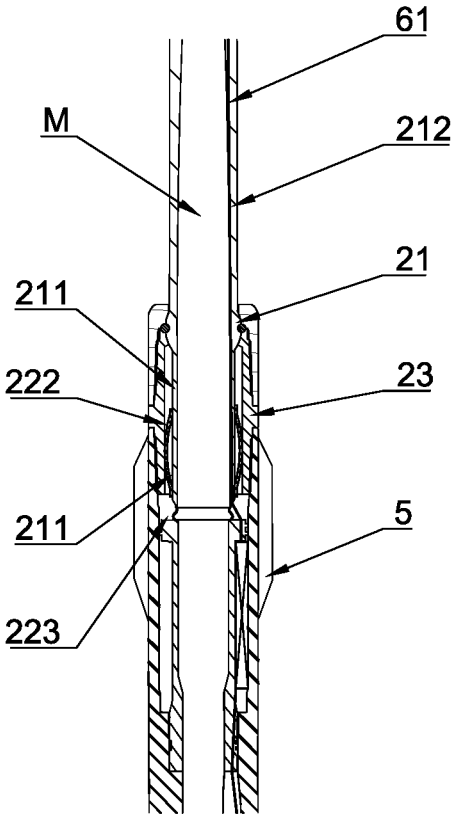
FIG. 2 is an enlarged schematic view illustrating an axial section of a WOB-TOB deflectable transmission joint of an easy building-up hybrid rotary steerable drilling system according to the present invention.
Figure 3:
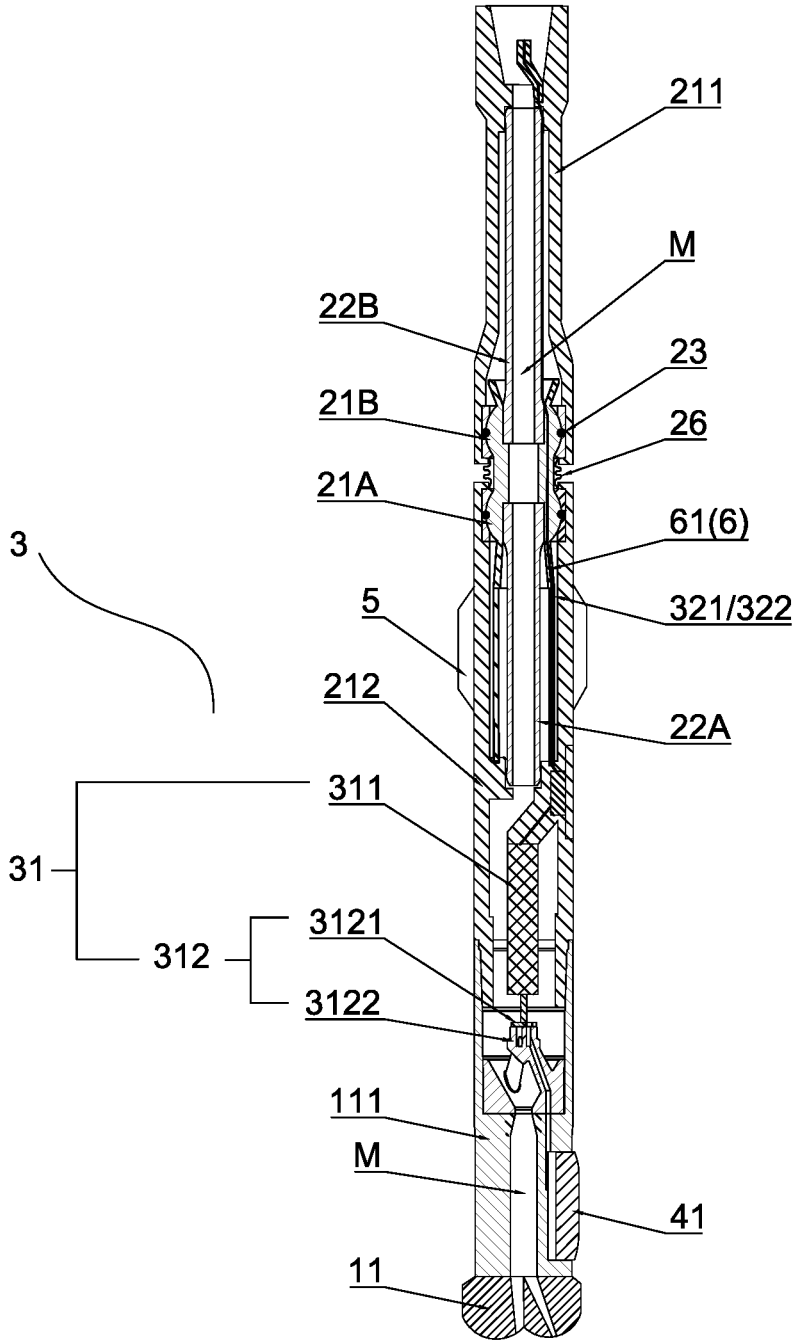
FIG. 3 is a schematic view illustrating an axial section of an easy building-up hybrid rotary steerable drilling system according to Embodiment 4 of the present invention.

The elastic pipe 221 is provided with a central through hole for flowing through the circulating drilling medium, and has a wall thickness of not less than 3 mm, which reliably obstructs the front push-the-bit assembly 4 from driving the front supporting body 1 to rotate around the center point of the universal joint 21, and makes the system more stable. Therefore, the easy building-up hybrid rotary steerable drilling system can be applied to the wellbore for building up as well as the convention straight well drilling, with the universal joint 21 not failed easily under the action of the impact force. The elastic pipe 221 can be reasonably selected according to the diameter expansion, building-up rate and WOB of the wellbore to adjust the damping force of the universal joint 21. In addition, the universal joint 21 not only can flow through the circulating drilling medium, but also can communicate the ground and the front push-the-bit assembly 4 through a cable and energy power transmission line 61, thereby supplying power to the front push-the-bit assembly 4 or implementing signal transmission. Specifically, the cable and energy power transmission line 61 may be provided in a sidewall of the elastic pipe 221. Preferably, as shown in FIGS. 1-2, the WOB-TOB deflectable transmission joint 2 further includes a limit mechanism 23 for limiting the deviation angle within a range of 0-5°, the limit mechanism 23 includes a lever structure and a supporting drill collar housing 231, and the lever structure is in contact with an inner wall of the supporting drill collar housing 232 and is configured to withstand a pushing force of a rotary steerable hydraulic piston 43 or a bending moment caused by downhole vibration. The lever structure may be formed by the output shaft and the input shaft of the universal joint 21 and the supporting drill collar housing 232, and used to limit the deflection of the output shaft of the universal joint 21.

In this case, as shown in FIG. 2, a deflection space 25 is formed between the lever structure and the inner wall of the supporting drill collar housing 232. Preferably, the elastic stabilizing device may further be a plurality of leaf springs 222 arranged in the deflection space 25. When the drill string causes the deflection of the WOB-TOB deflectable transmission joint 2 due to an external force, namely the rotation relative to the supporting drill collar housing 232, the deflection space 25 is occupied and the leaf springs 222 are compressed, thereby generating an elastic force for obstructing the rotation of the WOB-TOB deflectable transmission joint 2. The elastic force is helpful for restoration of a coaxial state between an output shaft and an input shaft of the WOB-TOB deflectable transmission joint 2, transmission of the WOB and the TOB, and protection of the WOB-TOB deflectable transmission joint 2. Preferably, a junction where the output shaft 211 of the universal joint 21 is connected to a rear end of the front supporting body 1 may be provided with a pressure seal 223 as shown in FIG. 2. The pressure seal 223 may be an extended structure of the leaf spring, and may also be an elastic sleeved structure similar to the leaf spring.

Preferably, the rigid universal joint includes a cross-axle universal joint, a ball cage universal joint, a Bendix-Weiss universal joint or a ball-and-socket hinge universal joint.

Embodiment 3

Unlike the above embodiment, the deflection control system 3 includes an electrical actuating device 31 configured to control the radial push-the-bit parts 41 to push the borehole wall toward the radial direction of the front supporting body 1 to generate a deflection force, an attitude measuring device 32 configured to measure a deviation angle of the universal joint, and a downhole computing device 33.

The downhole computing device 33 includes a computing chip electrically connected to the attitude measuring device 32, the electrical actuating device 31 and a power supply device 6. The computing chip receives deviation angle information acquired by the attitude measuring device 32, compares the deviation angle information with target deviation angle information to compute a steering direction and a steering force, and further controls the electrical actuating device 31 to drive the front push-the-bit assembly 4 to generate a combined pushing force reverse to the steering direction to act on the borehole wall; and a closed-loop control is performed to maintain a rotation angle and a rotation amplitude of the universal joint 21 in the WOB-TOB deflectable transmission joint 2 to be consistent with preset values to control the wellbore trajectory. The closed-loop control algorithm has an execution frequency of 0.5-60 s.

Preferably, the attitude measuring device 32 includes a deflection sensor 323 configured to measure a rotation angle and a rotation direction of the universal joint 21 in the WOB-TOB deflectable transmission joint 2; the corresponding deviation angle information includes rotation direction information and rotation angle information, measured by the deflection sensor 323, of the front supporting body 1 relative to the input shaft 212 of the universal joint; and the target deviation angle information includes rotation direction information and rotation angle information, prestored in the downhole computing device 33 or downlinked to the downhole computing device 33 through a communication device, of the front supporting body 1 relative to the input shaft 212 of the universal joint. In this case, the deflection control system 3 tracks change information of the deviation angle.

Alternatively, the attitude measuring device 32 includes a first accelerometer 321 and/or a first magnetometer 322 on the front supporting body 1, may be specifically provided on the front supporting body 1 and preferably near a position where the front push-the-bit assembly 4 is provided on the front supporting body 1, and configured to measure an attitude of the front supporting body 1. The corresponding deviation angle information includes inclination angle information and azimuth angle information measured by the first accelerometer 321 and the first magnetometer 322; and the target deviation angle information includes target inclination angle information and target azimuth angle information prestored in the downhole computing device 33 or downlinked to the downhole computing device 33 through the communication device. In this case, the deflection control system 3 tracks the change result of the deviation angle.

The first accelerometer 321 and/or the first magnetometer 322 on the front supporting body 1 are configured to measure attitude information of the front supporting body 1, namely the deviation angle information. The attitude information is uploaded to the wellhead through the communication system for interaction with the worker. And/or the attitude information is uploaded to the computing chip for wellbore trajectory control.

Alternatively, in addition to the first accelerometer 321 and/or the first magnetometer 322 on the front supporting body 1, the attitude measuring device 32 further includes a rear attitude measuring device 323 behind the WOB-TOB deflectable transmission joint 2. The rear attitude measuring device 323 at least includes a group of second acceleration sensors and a group of second magnetometers, and is configured to measure an attitude in an environment with relatively small vibration and magnetic disturbance. In this case, the deviation angle information includes inclination angle information measured by the first accelerometer and azimuth angle information measured by the second magnetometer; and the target deviation angle information includes target inclination angle information and target azimuth angle information prestored in the downhole computing device 33 or downlinked to the downhole computing device 33 through the communication device. The first accelerometer and the second accelerometer each may be either a quartz accelerometer or a micro-electromechanical system (MEMS) accelerometer or a combination thereof. Since the inclination angle is controlled more strictly than the azimuth angle in drilling engineering, the inclination angle is measured by the first accelerometer on the front supporting body, while the azimuth angle may be measured by the first magnetometer on the front supporting body. It is also proposed that the result measured by the rear second magnetometer is viewed as the azimuth angle at the front supporting body 1.

Preferably, the communication device may be any one of a mud pulse generator for transmitting the signal through mud, an intelligent drill pipe or an electromagnetic wave remote communication device or a combination thereof. The communication device is provided behind the WOB-TOB deflectable transmission joint 2 to implement communication between the downhole computing device 33 and a wellhead device. The power supply device 6 includes a downhole turbine generator provided behind the WOB-TOB deflectable transmission joint 2 and connected to the downhole computing device 33 through the cable and energy power transmission line 61. In order to implement the rotary steerable function better and more safely, the WOB-TOB deflectable transmission joint 2 should be as short as possible, and at least one WOB-TOB deflectable transmission joint 2 should be provided within 4 m toward the drill bit.

Preferably, 2-6 groups of front push-the-bit assemblies 4 are arranged in central symmetry on the circumferential surface of the front supporting body 1, the front push-the-bit assemblies 4 each include a hydraulic piston 42 and radial push-the-bit parts 41, and the radial push-the-bit parts 41 includes a wing rib 411 or a hydraulic piston-driven bushing.

The hydraulic piston 42 is powered by a drilling fluid, namely the circulating drilling medium; and the electrical actuating device 31 alternately provides a high-pressure drilling fluid in the main flow channel M for the hydraulic piston 42 by controlling a flow diverting device.

Preferably, the electrical actuating device 31 includes a motor 311, an rotary valve driven by the motor 312 and a motor driver; the motor driven is provided on the chip of the downhole computing device 33; the rotary valve driven by the motor 312 includes a rotary valve motor end 3121 and a rotary valve follow-up end 3122; and the rotary valve motor end 3121 and the rotary valve follow-up end 3122 each are provided with an overflowing hole. The motor driver adjusts the rotary valve driven by the motor 312 to a fixed direction according to a control instruction of the downhole computing device 33, namely rotates the rotary valve motor end 3121 relative to the rotary valve follow-up end 3122, such that mud is diverted through the overflowing hole of the flow diverting device to control the hydraulic piston 42 of the front wing rib assembly 4. For specific control methods, refer to the US patent US 2012/0160565 A1 or the US patent US005553679 A.

Embodiment 4

As shown in FIG. 2, the easy building-up hybrid rotary steerable drilling system provided by the present invention may include two WOB-TOB deflectable transmission joints 2 behind the front supporting body 1, namely a first WOB-TOB deflectable transmission joint 2A and a second WOB-TOB deflectable transmission joint 2B; a distance between a center point of a universal joint 21A in the first WOB-TOB deflectable transmission joint and a center point of a universal joint 21B in the second WOB-TOB deflectable transmission joint is less than 3 times a maximum diameter of the drill bit; the centralizer 5 is provided between the first WOB-TOB deflectable transmission joint 2A and the second WOB torque-deflecting transmission joint 2B, or in front of the first WOB torque-deflecting transmission joint 2A; or a center of the centralizer 5 coincides with the center point of the universal joint 21A or the center point of the universal joint 21B. When the centralizer 5 is provided in front of the first WOB torque-deflecting transmission joint 2A, a distance from the center point of the centralizer 5 to the center point of the universal joint 21A in the first WOB-TOB deflectable transmission joint 2A is not greater than 5 times the maximum diameter of the drill bit.

An input shaft of the universal joint of the first WOB-TOB deflectable transmission joint 2A and an output shaft of the universal joint of the second WOB-TOB deflectable transmission joint 2B are in fixed connection (including threaded connection or integral formation or other fixed connections), with the fixedly connected position coated by an antifouling seal 26. The antifouling seal 26 may be an elastic sleeve serving as an auxiliary member of the elastic stabilizing device. The first WOB-TOB deflectable transmission joint 2A includes a first elastic stabilizing device 22A, and the second WOB-TOB deflectable transmission joint 2B includes a second elastic stabilizing device 22B. The first elastic stabilizing device 22A penetrates the first universal joint 21A, and may extend forward to the front supporting body 1; and the second elastic stabilizing device 22B penetrates the second universal joint 21B and may extend backward to a drill string fixing device.

The larger the rotation angle of the WOB-TOB deflectable transmission joint 2, the lower the reliability. However, in order to meet the building-up requirements, the front push-the-bit assembly 4 drives the front supporting body 1 to rotate as much as possible relative to the universal joint 21A at a position nearer to the drill bit 11, namely rotate for a larger angle at the position near to the drill bit 11. Meantime, the centering fulcrum of the centralizer 5 is of importance to ensure the effect of the WOB-TOB deflectable transmission joint 2. Therefore, through the scheme in which the two universal joints (21A and 21B) are provided intensively, namely the input shaft of the universal joint of the first WOB-TOB deflectable transmission joint 2A and the output shaft of the universal joint of the second WOB-TOB deflectable transmission joint 2B are short and are directly in the fixed connection, or the input shaft of the universal joint of the first WOB-TOB deflectable transmission joint 2A and the output shaft of the universal joint of the second WOB-TOB deflectable transmission joint 2B are directly in integral formation, and the universal joint of the first WOB-TOB deflectable transmission joint 2A and the universal joint of the second WOB-TOB deflectable transmission joint 2B are respectively provided with the elastic stabilizing device 22A and 22B in a "back-to-back" manner, and with the centralization of the centralizer 5, the present invention equilibrates the building-up stability, the building-up rate and the system reliability in most drilling cases.

Embodiment 5

Figure 4:
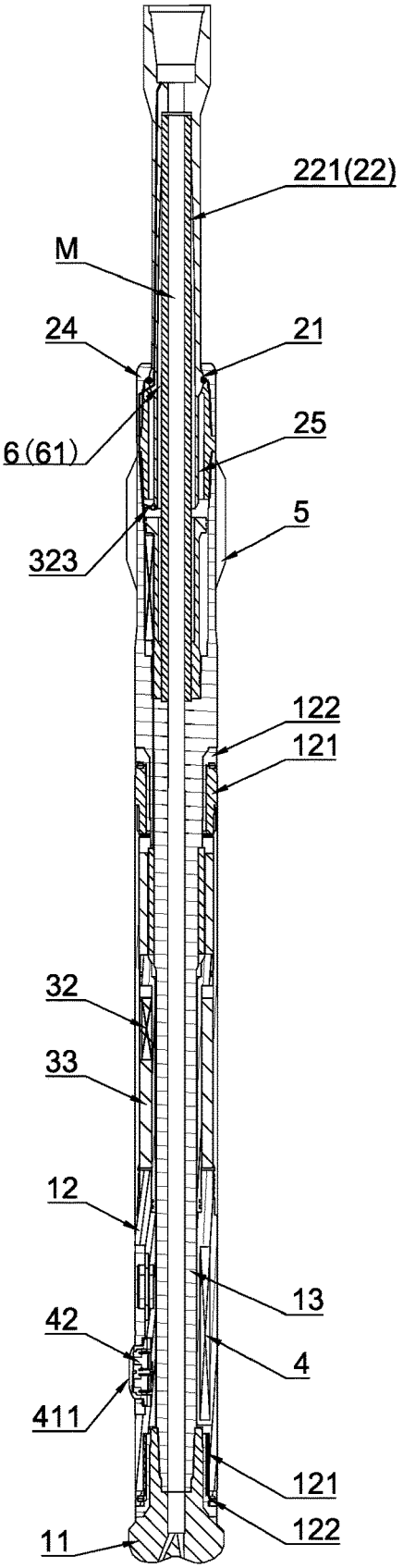
FIG. 4 is a schematic view illustrating an axial section of an easy building-up hybrid rotary steerable drilling system according to Embodiment 5 of the present invention.
Figure 5:
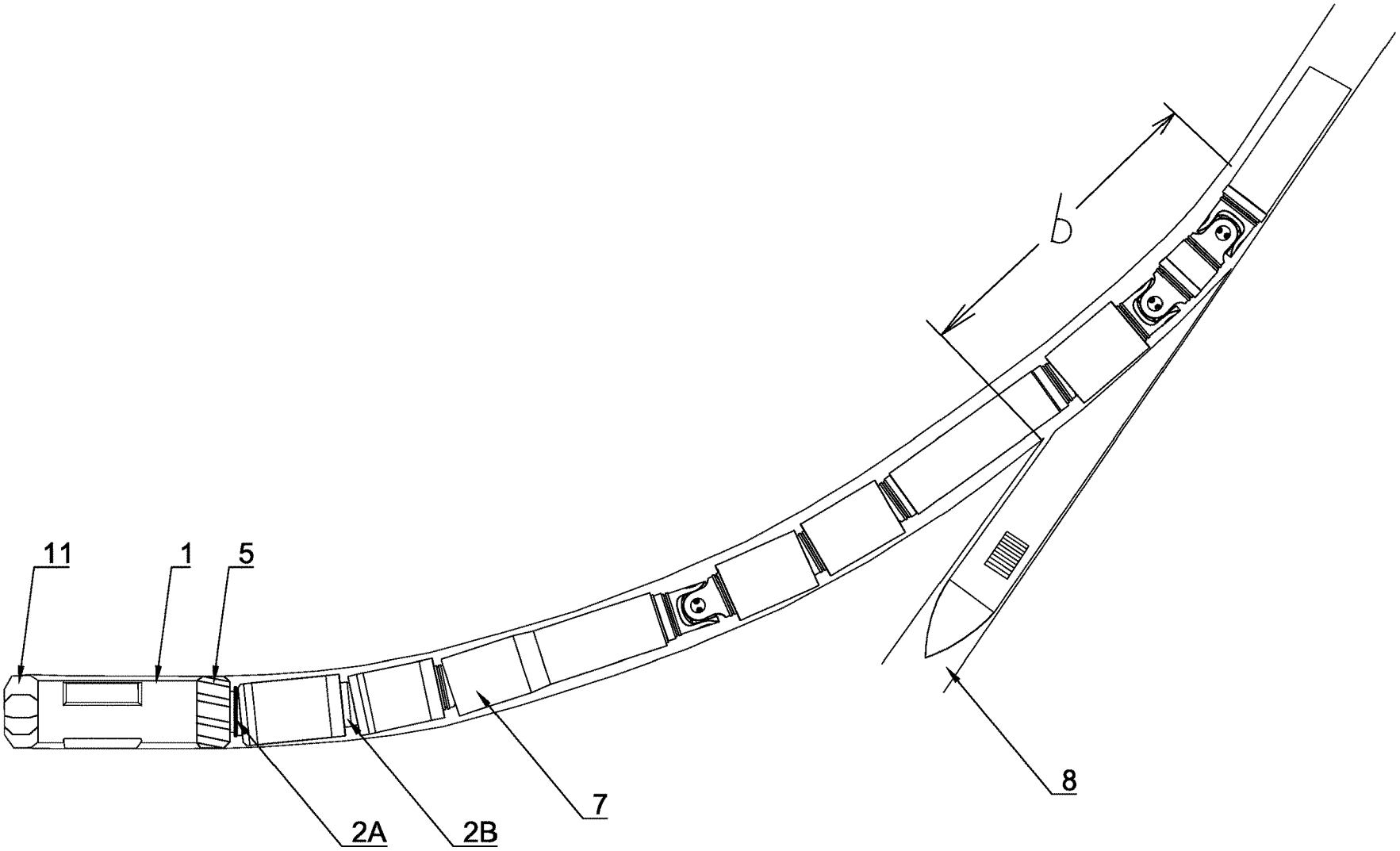
FIG. 5 is a schematic structural view of an easy building-up hybrid rotary steerable drilling system according to Embodiment 6 of the present invention.
Figure 6:
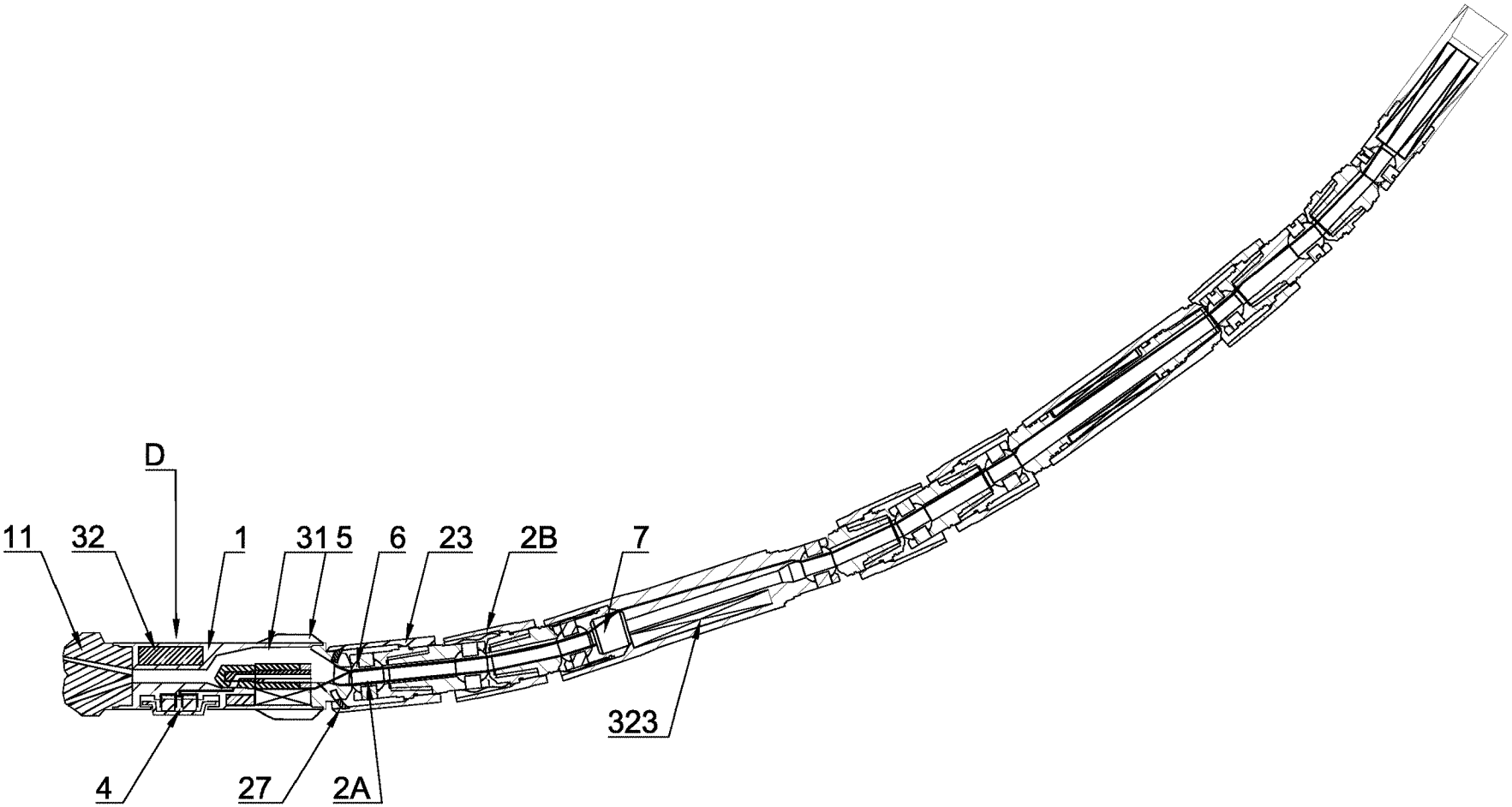
FIG. 6 is a schematic view illustrating an axial section of an easy building-up hybrid rotary steerable drilling system according to Embodiment 6 of the present invention.
Figure 7:
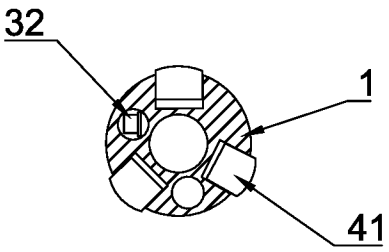
FIG. 7 is a schematic view illustrating a D-directional section of an easy building-up hybrid rotary steerable drilling system according to Embodiment 6 of the present invention.
Figure 8:
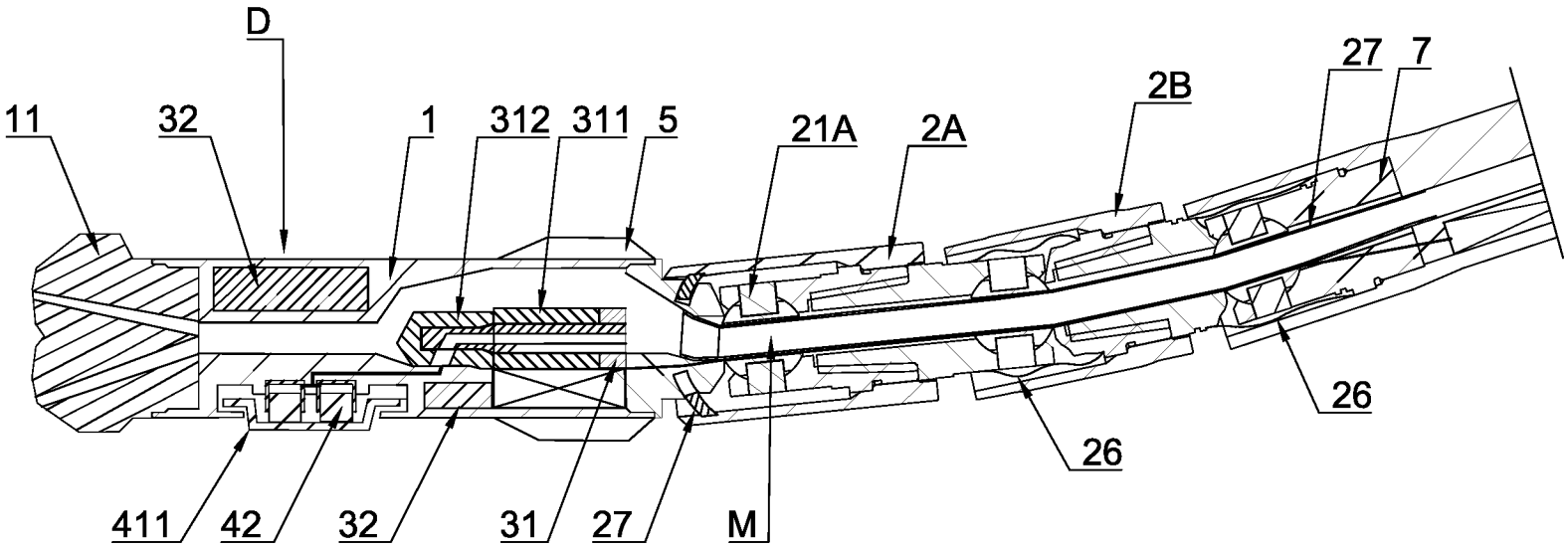
FIG. 8 is a partially enlarged schematic view illustrating an axial section of an easy building-up hybrid rotary steerable drilling system according to Embodiment 6 of the present invention.

The easy building-up hybrid rotary steerable drilling system provided by the present invention may further be a static bias rotary steerable drilling system. Specifically as shown in FIG. 4, the front supporting body 1 includes a steering sleeve 12 and a central shaft 13 freely rotating in the steering sleeve 12 through a radial anti-thrust bearing 121 and an axial anti-thrust bearing 122; the front push-the-bit assembly 4 is provided on a circumferential surface of the steering sleeve 12; a front end of the central shaft 13 is fixedly connected to the drill bit 11 (or the drill bit 11 is integrally formed with the central shaft 13), and a rear end of the central shaft 13 is fixedly connected to the output shaft 211 of the universal joint 21 (or the central shaft 13 is integrally formed with the output shaft 211 of the universal joint 21); the WOB-TOB deflectable transmission joint 2 further include a fixed sleeve 24 sleeved outside the universal joint 21; and a clearance between the fixed sleeve 24 and the universal joint 21 is formed into a deflection space 25. In this case, the fixed sleeve 24 may serve as the supporting drill collar housing of the limit mechanism 23 of the universal joint 21. The deflection space 25 is formed between the lever structure and an inner wall of the fixed sleeve 24. Preferably, the elastic stabilizing device may further be a plurality of leaf springs 222 arranged in the deflection space 25. When the drill string causes the deflection of the WOB-TOB deflectable transmission joint 2 due to an external force, namely the lever structure (which may be formed by the output shaft and the input shaft of the universal joint 21 and the fixed sleeve 24) rotates relative to the fixed sleeve 24, the deflection space 25 is occupied and the leaf springs 222 are compressed, thereby generating an elastic force for obstructing the rotation of the WOB-TOB deflectable transmission joint 2. The elastic force is helpful for restoration of a coaxial state between the output shaft and the input shaft of the WOB-TOB deflectable transmission joint 2, transmission of the WOB and the TOB, and protection of the WOB-TOB deflectable transmission joint 2. Preferably, the universal joint 21 can deflect by 0-5° in the deflection space 25 relative to an axis of the fixed sleeve 24.

The centralizer 5 is provided outside the steering sleeve 12 or the fixed sleeve 24; and when the centralizer 5 is located outside the fixed sleeve 24, a distance between a center point of the centralizer and a center point of the universal joint 21 is not greater than 3 times a diameter of the drill bit.

Embodiment 6

As shown in FIGS. 5-8, the easy building-up hybrid rotary steerable drilling system provided by the present invention further includes one or more series-connected universal WOB-TOB transmission joints 7 behind the WOB-TOB deflectable transmission joint. The universal WOB-TOB transmission joints 7 each are structurally identical to the WOB-TOB deflectable transmission joint 2 and include the universal joint 21, the elastic stabilizing device 22 and the limit mechanism 23. Preferably, the universal WOB-TOB transmission joints each further include an elastic pipe or other elastic stabilizing devices. In the easy building-up static bias rotary steerable device, the universal WOB-TOB transmission joints 7 each further include the fixed sleeve, so as to drill the ultra-short radius multilateral well from the sidewall of the main well 8. If the main well 8 has been cemented, windowing operation is performed and then the ultra-short radius multilateral well is drilled from the sidewall of the main well 8. Sealing measures are taken between universal joints of the universal WOB-TOB transmission joints to prevent leakage of the mud flowing through the hollow universal joints. The ultra-short radius multilateral well in the present invention refers to a multilateral wellbore having a maximum hole curvature of greater than 1°/m.

Preferably, a distance between center points of the universal joints in the universal WOB-TOB transmission joints 7 should be less than 10 times the diameter of the wellbore.

Preferably, a length of a universal WOB-TOB transmission joint array formed by the plurality of series-connected universal WOB-TOB transmission joints 7 is greater than a length of the front supporting body 1. In this way, the bending moment can be fully released, the front supporting body 1 and the WOB-TOB deflectable transmission joint 2 can better adapt to the window caused by sidetracking and the high-curvature wellbore, the safety of the ultra-short radius multilateral well drilling technology is improved, and the risk of clamping the front supporting body 1, the front push-the-bit assembly 4 or the drill bit 11 at the multilateral sidetracking well is prevented. Preferably, each of the one or more series-connected universal WOB-TOB transmission joints behind the WOB-TOB deflectable transmission joint has a circulation structure, and the elastic stabilizing device 22 thereof can be the elastic flow pipe 28 penetrating the one or more series-connected universal WOB-TOB transmission joints behind the WOB-TOB deflectable transmission joint overall.

Preferably, an anti-drop member 27 is provided at a junction between the WOB-TOB deflectable transmission joint 2 and the front supporting body 1. Specifically, the anti-drop member 27 is an arc-shaped member, one end of the anti-drop member 27 is clamped at a tail of the front supporting body 1, and the other end of the anti-drop member 27 is clamped in the supporting drill collar housing of the WOB-TOB deflectable transmission joint 2, which prevents the WOB-TOB deflectable transmission joint 2 from dropping out of the front supporting body 1 in case of the excessively large pushing force of the radial push-the-bit parts 41, and provides the dual protection for the deflection of the universal joint 21A.

The foregoing descriptions are merely specific implementations of the present invention, and the protection scope of the present invention is not limited thereto. Any modification or replacement easily conceived by those skilled in the art within the technical scope of the present invention should fall within the protection scope of the present invention. Therefore, the protection scope of the present invention should be subject to the protection scope defined by the claims.

What is claimed is:

1. A hybrid rotary steerable drilling system, comprising a front supporting body, a weight-on-bit (WOB)-torque-on-bit (TOB) deflectable transmission joint, a deflection control system, and a plurality of series-connected universal WOB-TOB transmission joints provided behind the WOB-TOB deflectable transmission joint; wherein the WOB-TOB deflectable transmission joint comprises a universal joint;

a front end of the front supporting body is fixedly connected to a drill bit, and a rear end of the front supporting body is fixedly connected to an outlet end of the universal joint;

at least one front push-the-bit assembly is provided on a circumferential surface of the front supporting body;

the deflection control system controls the front push-the-bit assembly to push a borehole wall along a radial direction of the front supporting body, wherein the front supporting body generates a deviation angle relative to an input end of the universal joint by taking a center point of the universal joint's center as a reference;

a distance between center points of universal joints of the plurality of series-connected universal WOB-TOB transmission joints is less than 10 times a maximum diameter of the drill bit; and a distance from a centroid of a universal joint of a WOB-TOB deflectable transmission joint nearest to the drill bit to the drill bit is less than 15 times the maximum diameter of the drill bit.

2. The hybrid rotary steerable drilling system according to claim 1, further comprising a centralizer behind the front push-the-bit assembly; wherein a center point of the centralizer is located behind the center point of the universal joint and a distance between the center point of the centralizer and the center point of the universal joint is less than or equal to 3 times a diameter of the drill bit; and the deflection control system controls radial push-the-bit parts of the front push-the-bit assembly to push the borehole wall along the radial direction of the front supporting body, wherein the front supporting body generates the deviation angle relative to an axis of the input end of the universal joint by taking the center point of the universal joint as a center and a contact point between the centralizer and the borehole wall as a fulcrum.

3. The hybrid rotary steerable drilling system according to claim 1, wherein each of the front supporting body, the WOB-TOB deflectable transmission joint and the plurality of series-connected universal WOB-TOB transmission joints has a circulation structure, and the circulation structure is formed into a main flow channel for allowing a circulating drilling medium to flow through.

4. The hybrid rotary steerable drilling system according to claim 3, further comprising an elastic flow pipe, wherein the elastic flow pipe penetrates a hollow structure of the universal joint and the elastic flow pipe is connected to the input end and the outlet end of the universal joint; and/or the WOB-TOB deflectable transmission joint further comprises an elastic stabilizing device for keeping an input shaft and an output shaft of the universal joint in a coaxial state.

5. The hybrid rotary steerable drilling system according to claim 4, wherein the elastic stabilizing device comprises an elastic pipe, wherein the elastic pipe penetrates a circulation structure of the universal joint and the elastic pipe is respectively coaxially connected to the input end and the outlet end of the universal joint; and a clearance is formed between the elastic pipe and the universal joint.

6. The hybrid rotary steerable drilling system according to claim 4, wherein a first WOB-TOB deflectable transmission joint and a second WOB-TOB deflectable transmission joint are sequentially arranged behind the front supporting body;

a distance between a center point of a universal joint of the first WOB-TOB deflectable transmission joint and a center point of a universal joint of the second WOB-TOB deflectable transmission joint is less than 3 times a maximum diameter of the drill bit;

a centralizer is provided between the first WOB-TOB deflectable transmission joint and the second WOB-TOB deflectable transmission joint, or the centralizer is provided in front of the first WOB-TOB deflectable transmission joint;

a distance from a centroid of the universal joint of the first WOB-TOB deflectable transmission joint to a centroid of the drill bit is less than 20 times the maximum diameter of the drill bit;

an input shaft of the universal joint of the first WOB-TOB deflectable transmission joint is fixedly connected to an output shaft of the universal joint of the second WOB-TOB deflectable transmission joint;

the first WOB-TOB deflectable transmission joint comprises a first elastic stabilizing device; and the second WOB-TOB deflectable transmission joint comprises a second elastic stabilizing device.

7. The hybrid rotary steerable drilling system according to claim 4, wherein each of the WOB-TOB deflectable transmission joint and the plurality of series-connected universal WOB-TOB transmission joints has the circulation structure; and the elastic stabilizing device penetrates the WOB-TOB deflectable transmission joint and the plurality of universal WOB-TOB transmission joints; and/or the easy building-up hybrid rotary steerable drilling system further comprises the elastic flow pipe, wherein the elastic flow pipe penetrates the hollow structure of the universal joint and the elastic flow pipe is connected to the input end and the outlet end of the universal joint through the hollow structure of the universal joint.

8. The hybrid rotary steerable drilling system according to claim 1, wherein the deflection control system comprises:

an electrical actuating device, wherein the electrical actuating device is configured to control radial push-the-bit parts to push the borehole wall toward the radial direction of the front supporting body to generate a deflection force, an attitude measuring device, and a downhole computing device; and the downhole computing device comprises a computing chip, wherein the computing chip is electrically connected to the attitude measuring device, the electrical actuating device and a power supply device.

9. The hybrid rotary steerable drilling system according to claim 8, wherein the computing chip receives deviation angle information acquired by the attitude measuring device, compares the deviation angle information with target deviation angle information to compute a steering direction and a steering force, and further controls the electrical actuating device to drive the front push-the-bit assembly to generate a combined pushing force reverse to the steering direction to act on the borehole wall; and a closed-loop control is performed to maintain a rotation angle and a rotation amplitude of the WOB-TOB deflectable transmission joint to be consistent with preset values to control a wellbore trajectory.

10. The hybrid rotary steerable drilling system according to claim 8, wherein the attitude measuring device comprises a first accelerometer and/or a first magnetometer on the front supporting body;

the deviation angle information comprises inclination angle information and/or azimuth angle information measured by the first accelerometer and/or the first magnetometer; and the target deviation angle information comprises target inclination angle information and/or target azimuth angle information, prestored in the downhole computing device or downlinked to the downhole computing device through a communication device, of the front supporting body relative to the input shaft of the universal joint.

11. The hybrid rotary steerable drilling system according to claim 8, wherein the attitude measuring device comprises a first accelerometer and/or a first magnetometer on the front supporting body, and further comprises a rear attitude measuring device behind the WOB-TOB deflectable transmission joint;

the rear attitude measuring device comprises a group of second acceleration sensors and a group of second magnetometers, and the rear attitude measuring device is configured to measure an attitude in an environment with vibration and magnetic disturbance;

the deviation angle information comprises inclination angle information and azimuth angle information measured by the accelerometer on the front supporting body and the group of second magnetometers; and the target deviation angle information comprises target inclination angle information and target azimuth angle information, prestored in the downhole computing device or downlinked to the downhole computing device through a communication device, of the front supporting body relative to the input shaft of the universal joint.

12. The hybrid rotary steerable drilling system according to claim 8, wherein the power supply device comprises a downhole turbine generator, and the downhole turbine generator; and/or a communication device implementing communication between the downhole computing device and a wellhead device are positioned behind the WOB-TOB deflectable transmission joint.

13. The hybrid rotary steerable drilling system according to claim 1, wherein an axial distance between the centralizer and the center point of the universal joint is less than or equal to 8 times a maximum diameter of the drill bit; and/or the WOB-TOB deflectable transmission joint is provided within a distance being 20 times the maximum diameter of the drill bit toward the drill bit; and/or an average outer diameter of the front supporting body is 50-100% of an outer diameter of the drill bit.

14. The hybrid rotary steerable drilling system according to claim 1, wherein 2-6 groups of the front push-the-bit assemblies are arranged in central symmetry on the circumferential surface of the front supporting body;

the front supporting body and the 2-6 groups of front push-the-bit assemblies on a surface of the front supporting body rotate with the drill bit;

each of the 2-6 groups of front push-the-bit assemblies comprises a hydraulic piston and radial push-the-bit parts;

each of the radial push-the-bit parts is a wing rib;

the hydraulic piston is powered by a circulating drilling medium in a main flow channel; and the electrical actuating device provides a high-pressure drilling fluid in the main flow channel for the hydraulic piston by controlling a flow diverting device.

15. The hybrid rotary steerable drilling system according to claim 14, wherein the electrical actuating device comprises a motor, a rotary valve driven by the motor and a motor driver; and the motor driver is provided on a downhole computing device, and rotates the rotary valve according to a control instruction of the downhole computing device, wherein mud is diverted through the flow diverting device to control one of the front wing rib assemblies.

16. The hybrid rotary steerable drilling system according to claim 1, wherein the universal joint is a cross-axle universal joint, a ball cage universal joint, a Bendix-Weiss universal joint or a ball-and-socket hinge universal joint.

17. The hybrid rotary steerable drilling system according to claim 1, wherein a sum for a length of a universal WOB-TOB transmission joint array formed by the plurality of series-connected universal WOB-TOB transmission joints, a length of the front supporting body and a length of the drill bit is greater than a length of a multilateral well section.

18. The hybrid rotary steerable drilling system according to claim 1, wherein only one centralizer is provided between the WOB-TOB deflectable transmission joint nearest to the drill bit and the drill bit; and a distance from a center of the only one centralizer to the drill bit is greater than a distance from the only one centralizer to the WOB-TOB deflectable transmission joint nearest to the drill bit; and the only one centralizer is configured to centralize the WOB-TOB deflectable transmission joint nearest to the drill bit at a near-bit position, wherein a radial force from a rear universal WOB-TOB transmission joint in a downhole vibration condition is prevented from disturbing a wellbore trajectory control.

19. A hybrid rotary steerable drilling system, comprising a front supporting body, a weight-on-bit (WOB)-torque-on-bit (TOB) deflectable transmission joint, a deflection control system, and a plurality of series-connected universal WOB-TOB transmission joints provided behind the WOB-TOB deflectable transmission joint; wherein the WOB-TOB deflectable transmission joint comprises a universal joint;

a front end of the front supporting body is fixedly connected to a drill bit, and a rear end of the front supporting body is fixedly connected to an outlet end of the universal joint;

at least one front push-the-bit assembly is provided on a circumferential surface of the front supporting body;

the deflection control system controls the front push-the-bit assembly to push a borehole wall along a radial direction of the front supporting body, wherein the front supporting body generates a deviation angle relative to an input end of the universal joint by taking a center point of the universal joint's center as a reference; and the WOB-TOB deflectable transmission joint further comprises a limit mechanism for limiting the deviation angle within a range of 0-5°, and each of the plurality of series-connected universal WOB-TOB transmission joints comprises the universal joint and the limit mechanism.

20. The hybrid rotary steerable drilling system according to claim 19, wherein the front supporting body comprises a steering sleeve and a central shaft, wherein the central shaft freely rotates in the steering sleeve through a radial anti-thrust bearing and an axial anti-thrust bearing;

the front push-the-bit assembly is provided on a circumferential surface of the steering sleeve;

a front end of the central shaft is fixedly connected to the drill bit, and a rear end of the central shaft is fixedly connected to the output shaft of the universal joint;

the WOB-TOB deflectable transmission joint further comprises a limit mechanism, wherein the universal joint only rotates by 0-5° relative to an axis of a fixed sleeve;

the centralizer is provided outside the steering sleeve or the fixed sleeve; and a distance between a center point of the centralizer and a universal joint of a first WOB-TOB deflectable transmission joint is less than or equal to 2 m.

21. A hybrid rotary steerable drilling system, comprising a front supporting body, a weight-on-bit (WOB)-torque-on-bit (TOB) deflectable transmission joint, a deflection control system, and a plurality of series-connected universal WOB-TOB transmission joints provided behind the WOB-TOB deflectable transmission joint; wherein the WOB-TOB deflectable transmission joint comprises a universal joint;

a front end of the front supporting body is fixedly connected to a drill bit, and a rear end of the front supporting body is fixedly connected to an outlet end of the universal joint;

at least one front push-the-bit assembly is provided on a circumferential surface of the front supporting body;

the deflection control system controls the front push-the-bit assembly to push a borehole wall along a radial direction of the front supporting body, wherein the front supporting body generates a deviation angle relative to an input end of the universal joint by taking a center point of the universal joint's center as a reference;

a power transmission line is provided in the WOB-TOB deflectable transmission joint behind the front supporting body, and the power transmission line is provided in the plurality of series-connected universal WOB- TOB transmission joints behind the WOB-TOB deflectable transmission joint; and the power transmission line is respectively electrically connected to a deflection control system, an attitude measuring device and a power source to supply power to the deflection control system and the attitude measuring device at a near-bit position.

* * * * *